US009999803B1

(12) United States Patent
Henschel

(10) Patent No.: US 9,999,803 B1
(45) Date of Patent: Jun. 19, 2018

(54) ORTHOPEDIC HAND LINEAR AND ROTATION

(71) Applicant: Robert Henschel, Chicago, IL (US)

(72) Inventor: Robert Henschel, Chicago, IL (US)

( * ) Notice: Subject to any disclaimer, the term of this patent is extended or adjusted under 35 U.S.C. 154(b) by 123 days.

(21) Appl. No.: 15/242,561

(22) Filed: Aug. 21, 2016

Related U.S. Application Data

(60) Provisional application No. 62/217,970, filed on Sep. 14, 2015.

(51) Int. Cl.

| | |
|---|---|
| ***A63B 21/02*** | (2006.01) |
| ***A63B 23/14*** | (2006.01) |
| ***A61H 1/00*** | (2006.01) |
| ***A61H 1/02*** | (2006.01) |
| ***A61H 5/00*** | (2006.01) |
| ***A63B 23/16*** | (2006.01) |
| ***A63B 21/04*** | (2006.01) |
| ***A63B 21/00*** | (2006.01) |
| ***A63B 71/06*** | (2006.01) |
| ***A61H 99/00*** | (2006.01) |

(52) U.S. Cl.
CPC ..... *A63B 23/16* (2013.01); *A61H 99/00* (2013.01); *A63B 21/04* (2013.01); *A63B 21/4035* (2015.10); *A63B 71/0619* (2013.01); *A61H 2205/06* (2013.01); *A61H 2205/065* (2013.01); *A63B 2071/0602* (2013.01)

(58) Field of Classification Search
CPC ... A63B 21/4035; A63B 21/02; A63B 21/023; A63B 21/025; A63B 21/04; A63B 21/047; A63B 22/201; A63B 22/203; A63B 23/14; A63B 23/16; A61H 1/0285; A61H 1/0274; A61H 1/0277; A61H 1/0281; A61H 2201/1253; A61H 2201/1635; A61H 2205/065
See application file for complete search history.

(56) References Cited

U.S. PATENT DOCUMENTS

| | | | | |
|---|---|---|---|---|
| 3,013,799 | A | 12/1961 | Wise | |
| 3,570,849 | A * | 3/1971 | Ratchford | A63B 23/16 482/49 |
| 3,743,284 | A | 7/1973 | Freeman et al. | |
| 4,111,417 | A * | 9/1978 | Gardner | A63B 21/05 482/128 |
| 4,171,801 | A | 10/1979 | Bell | |
| 4,226,412 | A * | 10/1980 | Panepinto | A63B 23/16 482/49 |
| 4,822,028 | A * | 4/1989 | McLellan | A63B 21/00069 482/114 |
| 5,125,878 | A * | 6/1992 | Wingate | A63B 23/16 482/121 |
| 5,480,367 | A * | 1/1996 | Bergman | A63B 21/0552 482/122 |
| 2008/0248927 | A1 * | 10/2008 | Ivey | A61H 1/0285 482/44 |

(Continued)

*Primary Examiner* — Nyca T Nguyen
(74) *Attorney, Agent, or Firm* — RG Patent Consulting, LLC; Rachel Gilboy

(57) ABSTRACT

A pair of therapeutic devices intended for use by persons in rehabilitative, physical or occupational therapy following hand and wrist surgeries or injuries with both of these devices being customized to better fit the needs of the recovering individual, and both provide superior control, monitoring, and feedback than do conventional therapy exercises.

6 Claims, 6 Drawing Sheets

(56) References Cited

U.S. PATENT DOCUMENTS

| | | | | |
|---|---|---|---|---|
| 2013/0217551 | A1* | 8/2013 | Parnell | A63B 21/0442<br>482/141 |
| 2014/0031175 | A1* | 1/2014 | Peralo | A61H 1/02<br>482/66 |
| 2014/0088466 | A1* | 3/2014 | Hansen | A61H 1/008<br>601/34 |
| 2014/0274605 | A1* | 9/2014 | McCanney | A63B 21/0428<br>482/129 |
| 2015/0133828 | A1* | 5/2015 | Hachisuka | A61H 1/0285<br>601/5 |
| 2015/0302777 | A1* | 10/2015 | Campolo | A61H 1/0274<br>434/262 |

* cited by examiner

ORTHOPEDIC HAND LINEAR AND ROTATION

CROSS-REFERENCE TO RELATED APPLICATION

The present applications are related to and claims priority from prior provisional application Ser. No. 62/217,970 filed Sep. 14, 2015 which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

The present invention relates generally to the field of hand and arm muscle rehabilitation or exercise devices and more specifically relates to a pair of therapeutic devices intended for use by persons in rehabilitative, recovering from a stroke, suffering from Arthritis, or physical or occupational therapy following hand and wrist surgeries or injuries with both of these devices being customized to better fit the needs of the recovering individual, and both provide superior control, monitoring, and feedback than do conventional therapy exercises.

2. Description of the Related Art

Physical therapy or physiotherapy is a physical medicine and rehabilitation specialty that remediates impairments and promotes mobility, function, and quality of life through examination, diagnosis, prognosis, and physical intervention (therapy using mechanical force and movements). It is carried out by physical therapists and physical therapist assistants. In addition to clinical practice, other activities encompassed in the physical therapy profession include research, education, consultation, and administration. In many settings, physical therapy services may be provided alongside, or in conjunction with, other medical services.

Physical therapists are Rehabilitation professionals who diagnose and treat individuals of all ages, from newborns to the very oldest, who have medical or surgical problems or other health-related conditions, illnesses, or injuries that limit their abilities to move and perform functional activities as well as they would like in their daily lives. PTs use an individual's history and physical examination to arrive at a diagnosis and establish a management plan and, when necessary, incorporate the results of laboratory and imaging studies like X-rays, CT-scan, or MRI findings.

In addition, PTs work with individuals to prevent the loss of mobility before it occurs by developing fitness and wellness-oriented programs for healthier and more active lifestyles, providing services to individuals and populations to develop, maintain and restore maximum movement and functional ability throughout the lifespan. This includes providing therapeutic treatment in circumstances where movement and function are threatened by aging, injury, disease or environmental factors. Functional movement is central to what it means to be healthy.

Various attempts have been made to solve problems found in hand and arm muscle rehabilitation or exercise devices art. Among these are found in: U.S. Pat. No. 3,013,799 to Charles S Wise; U.S. Pat. No. 3,743,284 to C Freeman; and U.S. Pat. No. 4,171,801 to Dean E. Bell. This prior art is representative of hand and arm muscle rehabilitation or exercise devices.

None of the above inventions and patents, taken either singly or in combination, is seen to describe the invention as claimed. Thus, a need exists for a reliable Orthopedic Hand Linear and Rotation, a pair of therapeutic devices intended for use by persons in rehabilitative, physical or occupational therapy following hand and wrist surgeries or injuries with both of these devices being customized to better fit the needs of the recovering individual, and both provide superior control, monitoring, and feedback than do conventional therapy exercises and to avoid the above-mentioned problems.

BRIEF SUMMARY OF THE INVENTION

In view of the foregoing disadvantages inherent in the known hand and arm muscle rehabilitation or exercise devices art, the present invention provides a novel Orthopedic Hand Linear and Rotation. The general purpose of the present invention, which will be described subsequently in greater detail, is to provide a pair of therapeutic devices intended for use by persons in rehabilitative, physical or occupational therapy following hand and wrist surgeries or injuries with both of these devices being customized to better fit the needs of the recovering individual, and both provide superior control, monitoring, and feedback than do conventional therapy exercises. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Orthopedic Hand Linear and Rotation, constructed and operative according to the teachings of the present invention.

Figure 1:
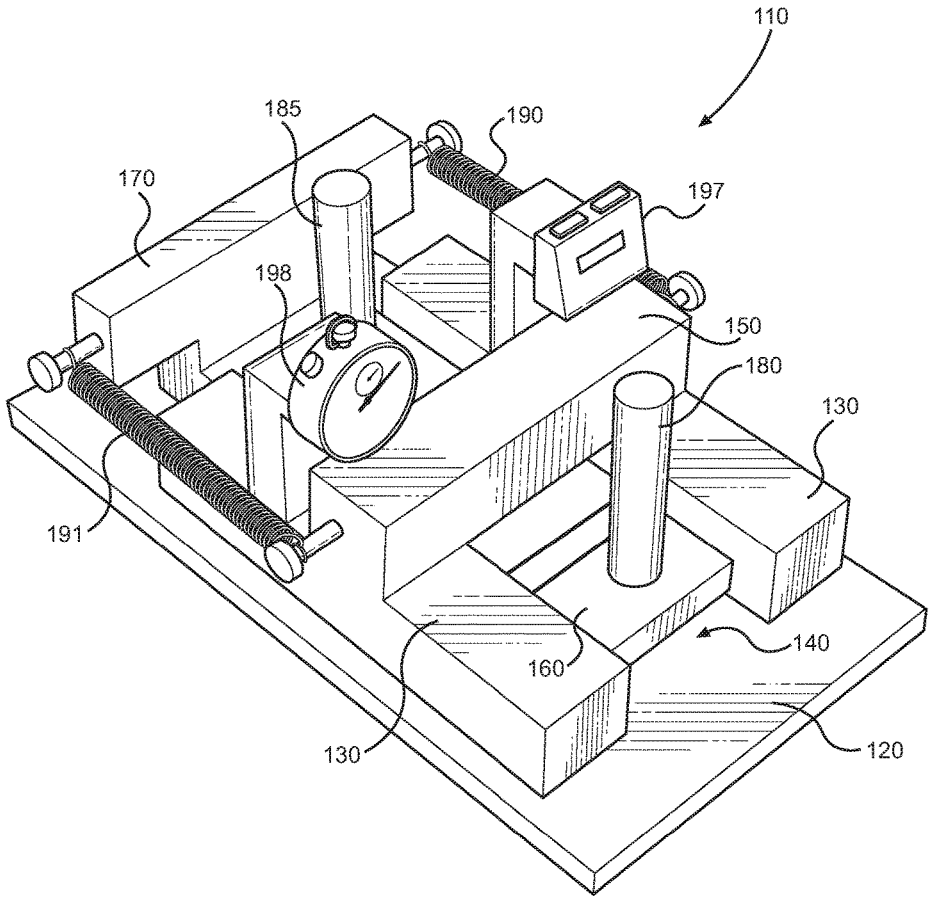
FIG. 1 shows a perspective view illustrating the linear device embodiment of the Orthopedic Hand Linear and Rotation device.

The various embodiments of the present invention will hereinafter be described in conjunction with the appended drawings.

DETAILED DESCRIPTION

As discussed above, embodiments of the present invention relate to a hand and arm muscle rehabilitation or exercise devices and more particularly to an Orthopedic Hand Linear and Rotation, a pair of therapeutic devices intended for use by persons in rehabilitative, physical or occupational therapy following hand and wrist surgeries or injuries with both of these devices being customized to better fit the needs of the recovering individual, and both provide superior control, monitoring, and feedback than do conventional therapy exercises.

Referring now to the drawings FIGS. 1-5, the Orthopedic Hand Linear and Rotation comprising a novel product offering consumers a practical solution to the aforementioned challenges. As the name implies, the Orthopedic Hand Linear and Rotation comprises two related devices, each designed to provide a specific therapeutic exercise. Each device will include a pair of C-clamps for tabletop mounting, and each will include a drawstring bag for parts, and a zippered nylon carry-bag for the device.

Figure 3:
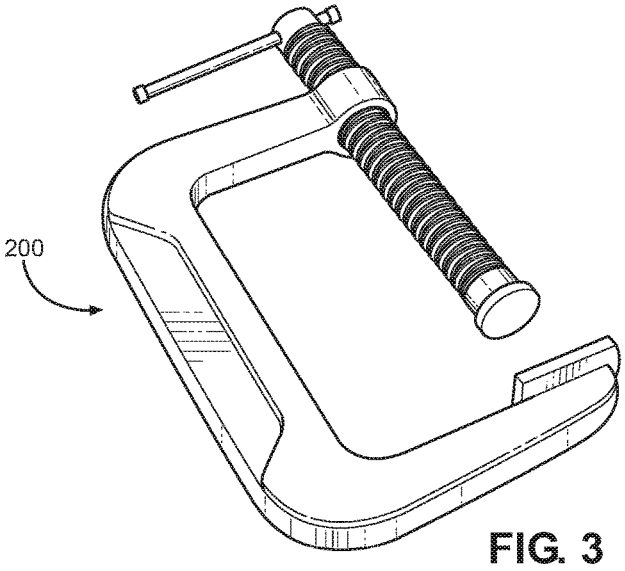
FIG. 3 shows a clamp used to secure the linear and rotational devices to a supporting surface.
Figure 5A:
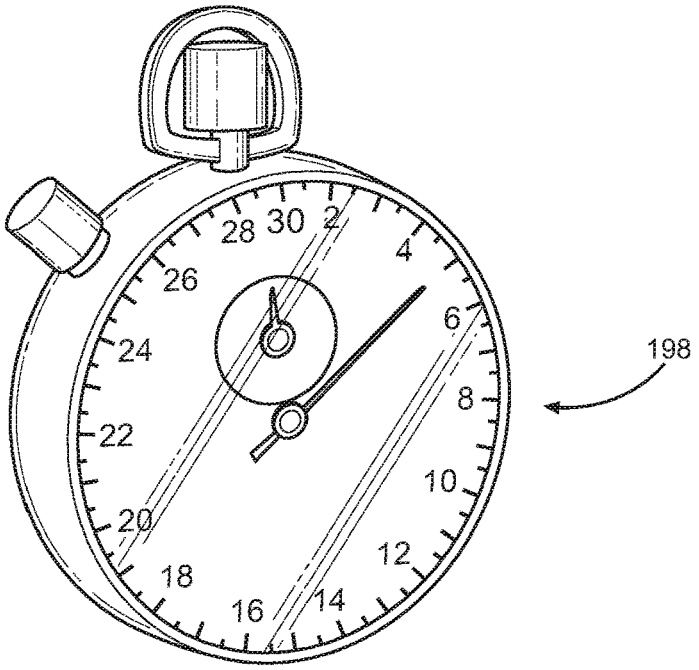
FIGS. 5*a* & 5*b* show perspective views illustrating time and repetition counters used with the hand and linear rotation devices of the present invention.
Figure 5B:
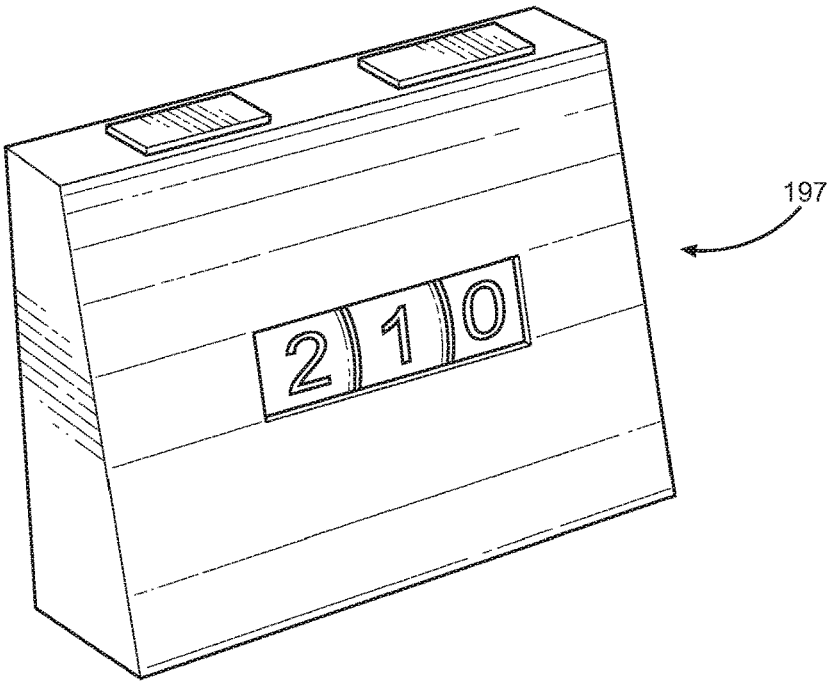
Figure 6:
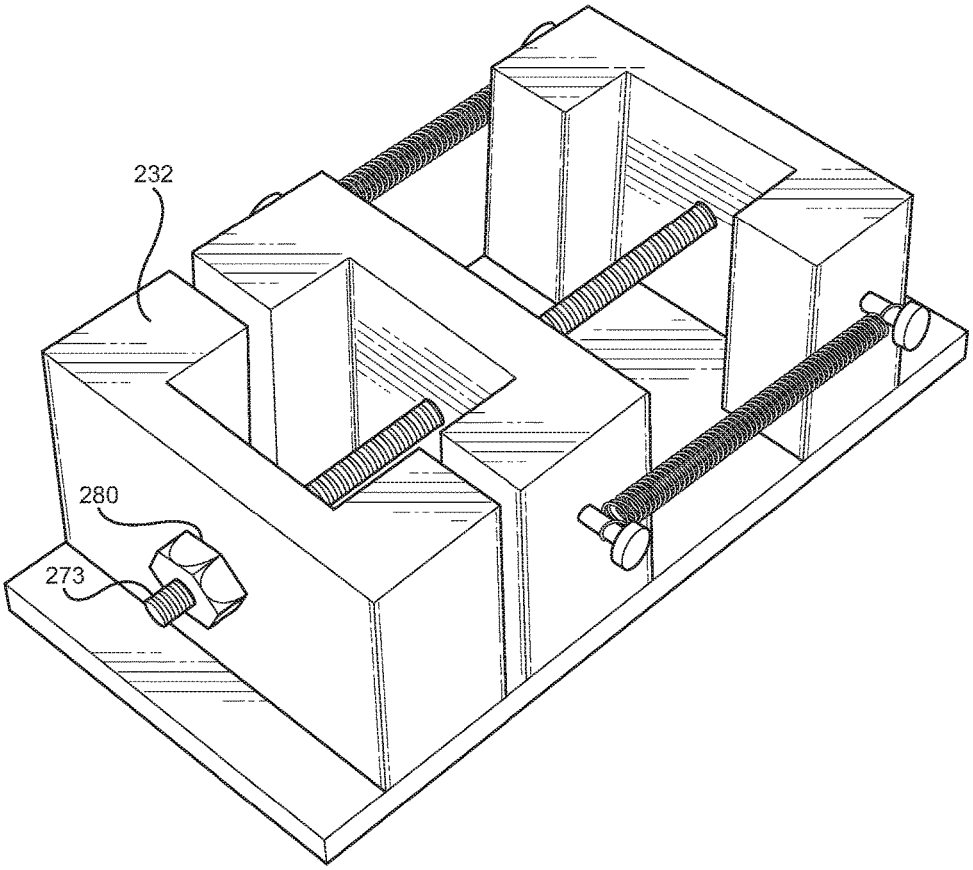
FIG. 6 shows a rear view of the rotational device of FIG. 2.

One of the devices, as illustrated in FIGS. 1, 3, and 5, the Orthopedic Hand Linear device 110, is designed to present the therapy patient with two exercises: one requiring the pushing of a bar-handle, slide-block assembly, forward along a horizontal track. The movement of the block encounters and overcomes a controlled resistance from springs. The other requiring the pulling of a second bar-handle, attached to the same block. The movement of the block, again encounters and overcomes resistance from the springs. The device measures approximately 14 inches in length, 7 inches in width, and 8 inches in height.

Two removable vertical members may be inserted, one into each side rail. One member features a mechanical counter, and the other features a timer. A horizontal bar fixed to the side rails acts as a "backstop." The system also permits a fine gradation of resistance according to the strength and position of the springs. (The Push/Pull device will offer seven combinations of the springs, so that as the hand grows stronger, the resistance of the device may be increased.) As opposed to the pushing of a dowel into a mass of clay, the Push/Pull device is controlled.

When activated, each handle must move horizontally and parallel to the side rails of the device, so that the motion required is uniform and more easily monitored for progress over time. Second, the variable-resistance spring system means that a patient's strength may be increased over time against a gradually increasing resistance—again, giving both patient and therapist clear and measurable, progressive feedback. Also, endurance of effort, as counted by a timer, and increasing over the course of treatment—is added to the therapy.

In particular, the Orthopedic Hand Linear device 110, as illustrated in FIGS. 1, 3, and 5, comprises a base member 120 formed as a rectangular flat plate and adapted to be clamped to a table surface; two rail members 130 fixedly attached to a top surface of the base member and are parallel to one another forming a horizontal track 140 therebetween; a main cross bar member 150 connected between top surfaces of the two rail members; a slide block 160 comprising flat top and bottom surface; a slide block cross bar member 170 extending across a distal end section of its top surface; a first handle member 180 placed upon the distal end section of the top surface and in proximity to the slide block cross bar member; a second handle member 185 placed upon a proximal end section of the top surface opposite the distal end section; wherein the slide block 160 is shaped and adapted to slide upon the top surface of the base member 120, fit between the two rail members 130, and under the main cross bar member 150; and wherein the first and second handle members are located on opposite sides of the main cross bar member; a first spring member 190 connected between distal ends of the main cross bar member and the slide block cross bar member; and a second spring member 190 connected between proximal ends of the main cross bar member and said slide block cross bar member; wherein the first handle member 180 is adapted to be pushed by a user to stretch out the first and second spring members; and wherein the second handle member 185 is adapted to be pulled by a user to stretch out the first and second spring members, such that a user can exercise their hand in linear directions.

The orthopedic hand linear device 110 could further comprise a third spring member 190 connected between distal ends of the main cross bar member and the slide block cross bar member; and a fourth spring member 190 connected between proximal ends of the main cross bar member and the slide block cross bar member, such that the tension between the main cross bar member and the slide block cross bar member is increased further. Furthermore, a fifth spring member 190 can be connected between distal ends of the main cross bar member and the slide block cross bar member; and a sixth spring member 190 can be connected between proximal ends of the main cross bar member and the slide block cross bar member, such that the tension between the main cross bar member and the slide block cross bar member can be increased even further.

The orthopedic hand linear device 110 could further comprise a mechanical counter mechanism 197 connected between one of the two rail members and the slide block and adapted to count the repetitions of the slide block being slid back and forth.

The orthopedic hand linear device 110 could further comprise a timing mechanism 198 connected to one of the two rail members and adapted to be used to measure the length of time a user is sliding the slide block back and forth.

The orthopedic hand linear device 110 could further comprise at least one clamp member 200 adapted to securely clamp said base member to a top surface of a table.

For measuring and exercise monitoring purposes, lines (and/or indicia) may be placed upon this device to measure the stroke length and resistance levels that the user experiences when first handle member 180 is moved forward and backwards while performing "push" and "pull" exercises.

Figure 2:
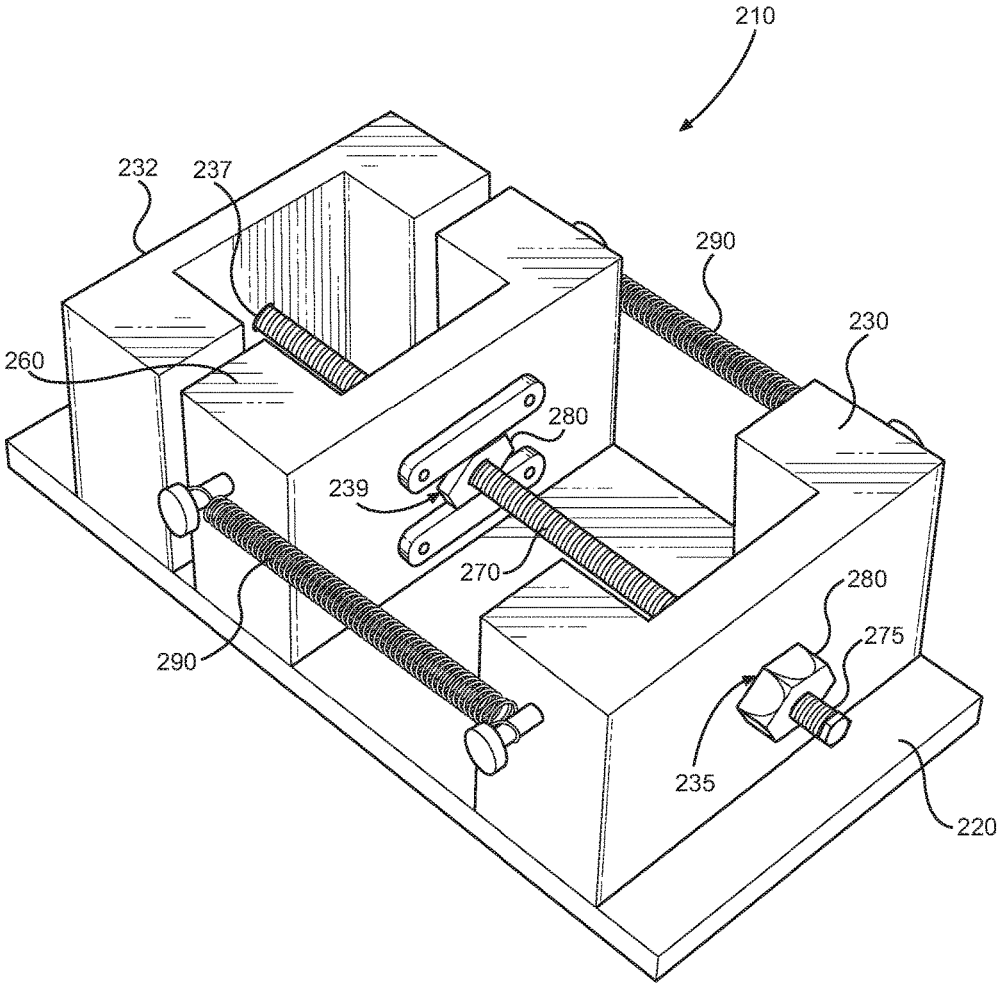
FIG. 2 shows a perspective view illustrating the rotational device embodiment of the Orthopedic Hand Linear and Rotation device.
Figure 4:
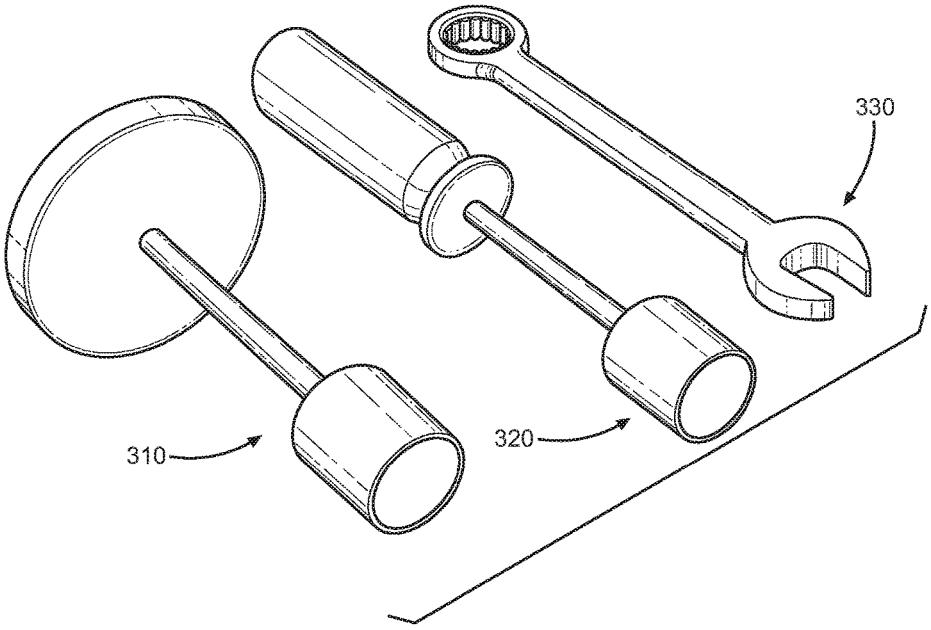
FIG. 4 shows a perspective view illustrating rotational hand tools used in the rotational device according to an embodiment of the present invention.

The second device, as illustrated in FIGS. 2 and 4, is the Orthopedic Hand Rotation device 210. This device measures 12 inches in length, 6 inches in width, and 5 inches in height. Like the Hand Linear (or Push/Pull) device, the Hand Rotation device is designed to exercise the user's hand and wrist by requiring a clockwise rotational motion, and then a counter-clockwise rotational motion. To this end, the device consists of several wooden blocks, with a centered block joined by springs and free to slide horizontally along the base. Through the center of these blocks travels a threaded steel rod, each end of which is fitted with a permanently mounted lock-nut. Where the rod passes through the movable block, the block is fitted with a nuts on one side, such that, as the rod rotates along their threads, the block moves laterally along the rod and along the base, its movement resisted by the springs attached to the blocks at either end.

In particular, as illustrated in FIGS. 2 and 4, the Orthopedic Hand Rotation device 210 comprises a base member 220 formed as a rectangular flat plate adapted to be clamped to a table surface; a first fixed block member 230 comprising a center hole 235 having a cylindrical threaded nut member attached therein, and attached to a proximal end section of the base member; a second fixed block member 232 comprising a center hole 237 having a cylindrical threaded nut member attached therein, and attached to a distal end section of said base member; a slide block 260 comprising a center hole 239 having a cylindrical threaded nut member attached therein, and adapted to be placed in between the first and second fixed block members and slide upon the base member 220; an elongated screw member 270 comprising a tool attachment section 275 on a proximal end thereof, wherein the elongated screw member 270 is threadingly and rotationally placed within the threaded nut members of the first and second fixed block members and the slide block, and is adapted to extend beyond an end surface of the first fixed block member such that a tool (any one of toll members 310, 320, and 330) can be attached to the tool attachment section and be used to rotate the elongated screw member; a first spring member 290 connected between distal ends of the first fixed block member 230 and said slide block 260; a second spring member 290 connected between proximal ends of the first fixed block member 230 and the slide block 260; and a set of tools (including members 310, 320, and 330), wherein each tool of the set of tools is adapted to fit upon the tool attachment section 275 of the elongated screw member 270 and be used to rotate the elongated screw member; and wherein a user can choose one of the tools from the set of tools, connect it to the tool attachment section of the elongated screw member, rotate the elongated screw member to thereby stretch out the first and second spring members, such that a user can exercise their hand in rotational directions.

The orthopedic hand rotation device 210 could further comprise a third spring member 290 connected between distal ends of the first fixed block member and the slide block; and a fourth spring member 290 connected between proximal ends of the first fixed block member and the slide block, such that the tension between the first fixed block member and the slide block can be increased further.

The orthopedic hand rotation device 210 could further comprise a fifth spring member 290 connected between distal ends of the first fixed block member and the slide block; and a sixth spring member 290 connected between proximal ends of the first fixed block member and the slide block, such that the tension between the first fixed block member and the slide block can be increased even further.

The orthopedic hand rotation device 210 could further comprise at least one clamp member 200 adapted to securely clamp the base member 220 to a top surface of a table.

The orthopedic hand rotation device 210 could further comprise a first lock nut 280 placed upon a section of the elongated screw member in between the first fixed block member 230 and the tool attachment section 275, a second lock nut 280 placed upon a distal end section 273 of the elongated screw member and adjacent an outer surface of the second fixed block member 232, and a third lock nut 280 placed upon a center section of the elongated screw member and adjacent an outer surface of the slide block 260, such that the elongated screw member 270 is adapted to limit the distance the slide block can travel.

The set of tools could comprise a disc rotating tool 310, a screw driver tool 320, and a wrench tool 330.

Figure 7:
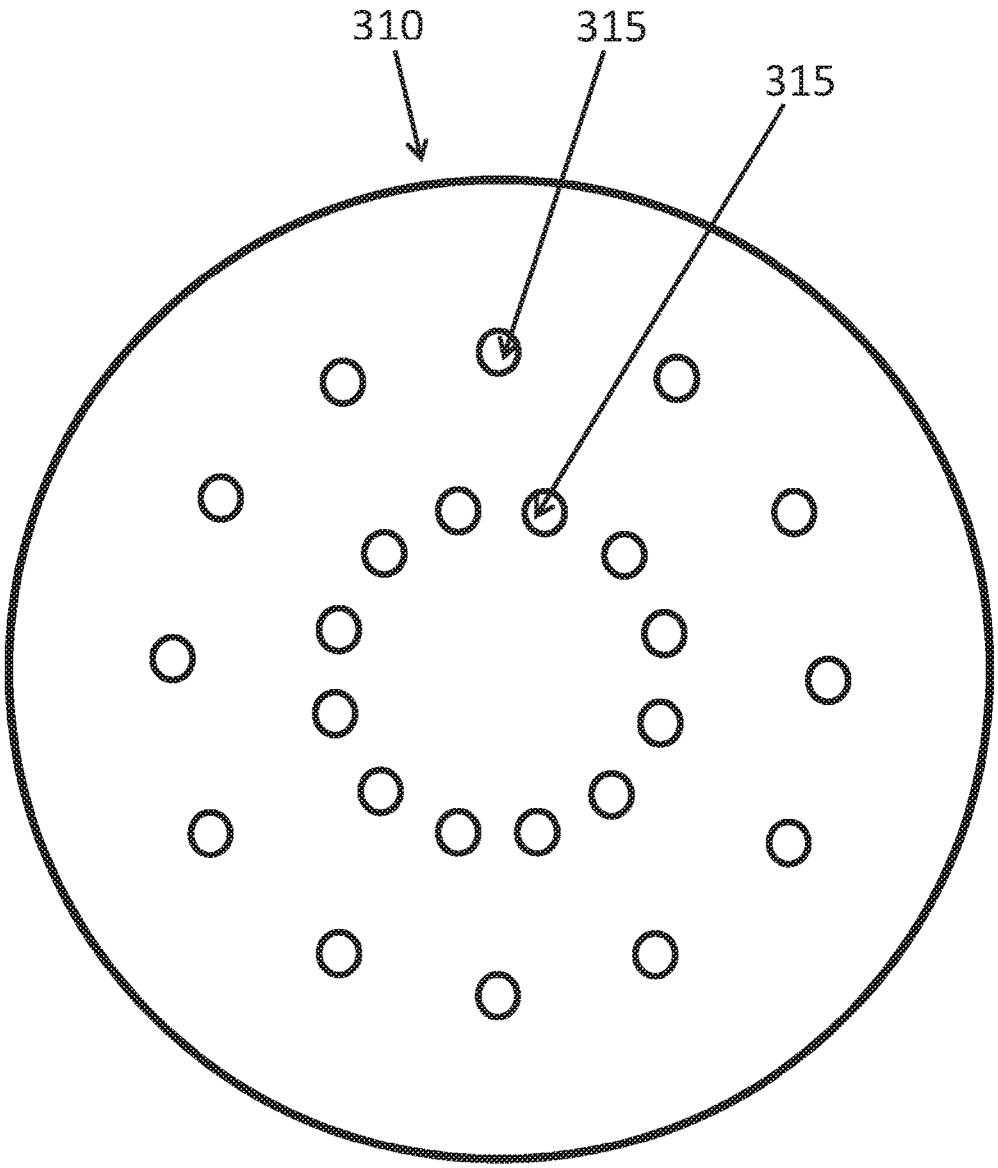
FIG. 7 shows a front view illustrating an embodiment of one of the rotational hand tools of FIG. 4 including a disc with finger holes therein.

As illustrated in FIG. 7, the disc rotating tool 310 can be formed with a series of holes 315 therethrough sized, shaped, and adapted to allow a user to place their fingers of one hand in chosen holes in different configurations for differing hand rotational exercises. Therefore, a user can either grab the outer circumference and rotate the tool or choose to place their fingers in chosen holes to thereby exercise different muscles. The hole pattern shown if FIG. 7 is simply an example. Other patterns and positions are also incorporated herein.

For measuring and exercise monitoring purposes, lines (and/or indicia) may be placed upon this device to measure the resistance levels that the user experiences when the rotating tools are rotated while performing the rotational exercises.

Both the Hand Linear Device and the Hand Rotation Device present themselves as clearly superior to their "equivalents" now in use by physical and occupational therapists. Both instruments have been engineered to provide variable, progressive resistance. Both have been engineered to provide precise, measurable feedback for the patient and the therapist; and both have the distinct advantage of being usable, by many patients in succession, over the long term. The Orthopedic Hand Linear and Rotation is cost-effective to produce.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An orthopedic hand linear device comprising:

a base member;

wherein said base member is formed as a rectangular flat plate adapted to be clamped to a table surface;

two rail members;

wherein said two rail members are fixedly attached to a top surface of said base member and are parallel to one another forming a horizontal track therebetween;

a main cross bar member:

wherein said main cross bar member is connected between top surfaces of said two rail members;

a slide block comprising;

flat top and bottom surfaces; and a slide block cross bar member extending across a distal end section of said top surface;

a first elongated handle member placed upon said distal end section of said top surface and in proximity to said slide block cross bar member; and a second elongated handle member placed upon a proximal end section of said top surface opposite said distal end section;

wherein said slide block is shaped and adapted to slide upon said top surface of said base member, fit between said two rail members, and under said main cross bar member; and wherein said first and second elongated handle members are located on opposite sides of said main cross bar member;

a first spring member;

wherein said first spring member is connected between distal ends of said main cross bar member and said slide block cross bar member; and a second spring member;

wherein said second spring member is connected between proximal ends of said main cross bar member and said slide block cross bar member;

wherein said first elongated handle member is adapted to be pushed by a user to stretch out said first and second spring members; and wherein said second elongated handle member is adapted to be pulled by the user to stretch out said first and second spring members, such that a user can exercise their hand in linear directions.

2. The orthopedic hand linear device of claim 1, further comprising a third spring member connected between distal ends of said main cross bar member and said slide block cross bar member; and a fourth spring member connected between proximal ends of said main cross bar member and said slide block cross bar member, such that the tension between said main cross bar member and said slide block cross bar member is increased further.

3. The orthopedic hand linear device of claim 2, further comprising a fifth spring member connected between distal ends of said main cross bar member and said slide block cross bar member; and a sixth spring member connected between proximal ends of said main cross bar member and said slide block cross bar member, such that the tension between said main cross bar member and said slide block cross bar member is increased further.

4. The orthopedic hand linear device of claim 1, further comprising a mechanical counter mechanism connected between one of said two rail members and said slide block and adapted to count the repetitions of said slide block being slid back and forth.

5. The orthopedic hand linear device of claim 1, further comprising a timing mechanism connected to one of said two rail members and adapted to be used to measure the length of time the user is sliding said slide block back and forth.

6. The orthopedic hand linear device of claim 1, further comprising at least one clamp member adapted to securely clamp said base member to a top surface of the table.

* * * * *